US011759025B2

(12) United States Patent
Chinomi

(10) Patent No.: US 11,759,025 B2
(45) Date of Patent: Sep. 19, 2023

(54) OUTER LAYER ENGAGEMENT CLIP

(71) Applicant: NIFCO INC., Yokosuka (JP)

(72) Inventor: Yuhei Chinomi, Yokosuka (JP)

(73) Assignee: NIFCO INC., Yokosuka (JP)

( * ) Notice: Subject to any disclaimer, the term of this patent is extended or adjusted under 35 U.S.C. 154(b) by 135 days.

(21) Appl. No.: 17/437,629

(22) PCT Filed: Mar. 19, 2020

(86) PCT No.: PCT/JP2020/012401
§ 371 (c)(1),
(2) Date: Sep. 9, 2021

(87) PCT Pub. No.: WO2020/196305
PCT Pub. Date: Oct. 1, 2020

(65) Prior Publication Data

US 2022/0151394 A1 May 19, 2022

(30) Foreign Application Priority Data

Mar. 26, 2019 (JP) ..... 2019-057523

(51) Int. Cl.
*A47C 31/02* (2006.01)

(52) U.S. Cl.
CPC ..... *A47C 31/02* (2013.01)

(58) Field of Classification Search
CPC ..... A47C 31/02
See application file for complete search history.

(56) References Cited

U.S. PATENT DOCUMENTS 3,794,378 A * 2/1974 Haslam ..... B60N 2/5825 297/452.6
3,807,675 A * 4/1974 Seckerson ..... F16L 3/13 248/223.41

(Continued)

FOREIGN PATENT DOCUMENTS

CN 105034883 A 11/2015
JP 2013-132328 A 7/2013

(Continued)

OTHER PUBLICATIONS

China National Intellectual Property Administration, "Office Action for Chinese Patent Application 202080022050.3," dated Sep. 28, 2022.

(Continued)

*Primary Examiner* — Rodney B White
(74) *Attorney, Agent, or Firm* — Manabu Kanesaka

(57) ABSTRACT

In a clip for engagement of an outer layer, the outer layer covering a foam member in a state held by the foam member being caught to a foam member side by engagement of an engaged portion provided at a rear side of the outer layer, the clip includes a base configured to be held by the foam member, a pair of projection walls erected on the base and facing each other, engagement portions extending from the projection walls in a width direction of the projection walls, and arranged to be swingable substantially parallel to the base or horizontally, wherein the engaged portion is configured to be sandwiched between the engagement portions to elastically engage. Accordingly, since the engagement portion bends horizontally relative the base, the overall height can be made low.

6 Claims, 8 Drawing Sheets

(56) References Cited

U.S. PATENT DOCUMENTS

| | | | | |
|---|---|---|---|---|
| 6,899,399 | B2 * | 5/2005 | Ali | B60N 2/5825 297/452.6 X |
| 7,559,100 | B2 * | 7/2009 | Pedde | F16B 5/0692 297/218.2 X |
| 8,091,184 | B2 * | 1/2012 | Santin | B60N 2/5825 24/339 |
| 8,099,837 | B2 * | 1/2012 | Santin | A47C 31/023 297/218.2 X |
| 8,197,010 | B2 * | 6/2012 | Galbreath | B60N 2/5825 297/218.2 X |
| 8,474,111 | B2 * | 7/2013 | Ribes Marti | F16B 5/0621 24/294 |
| 8,690,257 | B2 * | 4/2014 | Stiller | B60N 2/5825 297/452.6 X |
| 8,857,018 | B2 * | 10/2014 | Murasaki | B60N 2/5825 297/218.1 X |
| 9,180,804 | B2 * | 11/2015 | Tsunoda | F16B 5/0642 |
| 9,315,134 | B2 * | 4/2016 | Kheil | B60N 2/5891 |
| 9,669,744 | B2 * | 6/2017 | Cao | B60N 2/5816 |
| 9,751,441 | B2 | 9/2017 | Sato et al. | |
| 9,834,431 | B2 * | 12/2017 | Agonia | B60N 2/5825 |
| 9,896,008 | B2 * | 2/2018 | Sato | B60N 2/5825 |
| 10,052,986 | B2 | 8/2018 | Sato et al. | |
| 10,744,916 | B2 * | 8/2020 | Agonia | B60N 2/5825 |
| 10,857,918 | B2 * | 12/2020 | Furuuchi | B60N 2/5825 |
| 2003/0162008 | A1 * | 8/2003 | Cappucci | B29C 44/1271 428/184 |
| 2003/0215601 | A1 * | 11/2003 | Pedde | B60N 2/5825 428/102 |
| 2004/0093701 | A1 * | 5/2004 | Dickinson | F16B 21/075 24/294 |
| 2009/0165263 | A1 * | 7/2009 | Smith | B60N 2/5841 24/297 |
| 2015/0307001 | A1 | 10/2015 | Sahashi | |
| 2015/0328808 | A1 * | 11/2015 | Sasaki | B60N 2/5825 264/46.4 |
| 2021/0053472 | A1 * | 2/2021 | Eldridge | A47C 31/023 |

FOREIGN PATENT DOCUMENTS

| | | | | |
|---|---|---|---|---|
| JP | 2015-123329 | A | 7/2015 | |
| JP | 2016-185204 | A | 10/2016 | |
| JP | 2016-186324 | A | 10/2016 | |
| WO | WO-2021177405 | A1 * | 9/2021 | A47C 31/02 |

OTHER PUBLICATIONS

PCT/ISA/210, "International Search Report for International Application No. PCT/JP2020/012401," dated May 26, 2020.

* cited by examiner

OUTER LAYER ENGAGEMENT CLIP

TECHNICAL FIELD

The present invention relates to an outer layer engagement clip.

BACKGROUND

FIGS. 8(*a*) and 8(*b*) show an outer layer engagement clip disclosed in a Patent Document 1 described below. The clip 10 includes a base 14, and engagement portions 34, and in a condition that a foam material 122 is retained on the base 14, an outer layer covering the foam material can be held on a side of the foam material by engaging a suspender 118 connected to an engaged portion 117 provided on a rear side of the front layer at the engagement portion 34. Here, the foam material 122 includes a main portion 112A, and a groove portion 116 (126) for placing the clip 10 at a border of the support portion 112B at both sides of the main portion. And, in this clip 10, the base 14 is retained to be buried at two sides of the grove bottom portion of the foam material 122. The suspender 118 has projections 118A projecting left and right. The engagement portion 34 includes a pair of extended portions 50 provided to erect on the base 14 and facing each other, a pair of engagement claws 52 formed at the tip sides of the extended portions 50 and sandwiching the suspender 118 to engage, projections 54 projecting on sides opposite to sides where the extended portions 50 face, and standing portions 56, which stand on the base 14 and abut against the projections 54 when the pair of engagement claws 52 is elastically deformed in a direction away from each other through the extended portions.

In the above structure, in a roller crushing process after forming the foam material 122, i.e. rotating a roller while pushing the roller to the foam material, the sizes of foams in the foam material are adjusted, wherein a pushing force at the time of pushing the roller is applied to the engagement portions 34. Then, upon acting the pushing force to the engagement portions, the respective engagement claws 52 elastically deform in the direction away from each other through the extended portions 50, so that the projections 54 at the sides of the extended portions abut against the standing portions 56, thereby suppressing an excessive deformation of the extended portions 50. Namely, the projections 54 abut against the standing portions 56 at the time of roller crushing, to thereby prevent the damage of the clip.

PRIOR ART DOCUMENT

Patent Document

Patent Document 1: Japanese Patent Publication No. 2016-186324.

SUMMARY OF THE INVENTION

Problems to be Solved by the Invention

By the way, in using the above clip, since the clip is disposed with a sufficient space in the groove of the foam material, for example, the depth of the groove is largely required in comparing with the height of the engaging claw from the base. For example, when the groove is made shallow or the height of the engagement claw is made lower, the design specification for the insertion force and the removing force when the suspender is operated can not be satisfied. In other words, in the conventional clip, there are limitations for the thickness of the foam material and the depth of the groove, and free design for the layout is limited.

The object of the present invention is to eliminate the above problems, and to provide an outer layer engagement clip such that it is possible to lower or reduce the height size of the clip, and the thickness of the foam material and the depth of the groove portion can be freely changed. Other objects of the invention will be apparent from the following description of invention.

Means for Solving the Problems

In order to solve the above problems, a clip for engagement of an outer layer, the outer layer covering a foam member in a state held by the foam member being caught to a foam member side by engagement of an engaged portion provided at a rear side of the outer layer, comprises a base configured to be held by the foam member, a pair of projection walls erected on the base and facing each other, and engagement portions extending from side portions in a width direction of the projection walls, and arranged to be swingable substantially parallel to the base or horizontally, wherein the engaged portion is configured to be sandwiched between the engagement portions to elastically engage.

In the above present invention, "a side portion of the projection wall" means, in the projection walls, a side portion located at the width direction, i.e. a side portion in a direction crossing a longitudinal direction of the base, which is a side, in an example shown in FIG. 4, crossing a groove in a state of being arranged in the longitudinal direction of the groove, a left or right end of a projection wall in an example shown in FIG. 5(*a*), and a front or rear end of the projection wall in an example of FIG. 5(*b*). An "engaged portion" is not only limited to a pull member in which a wire is inserted as indicated in an example, but it may be, for example, a suspender having a projection disclosed in the Patent Document 1, or a pull member formed with an extending portion or an enlarged portion at a tip of the thin plate shape attachment member as disclosed in Japanese Patent Publication No. 2013-132328. "Foam member" is formed by dispersing gasses in a synthetic resin in a foam shape or a multi-hole shape, and may be called synthetic foam, such as urethane foam, or cushion foam.

The present invention may be embodied as in the following embodiments. Namely, (A) the engagement portions are provided on two sides of the projection wall. In this structure, in addition to the advantages as explained later, an engagement force or retaining force relative to the engaged portion can be doubled. Also, as compared with the conventional structure as shown in FIGS. 8(*a*) and 8(*b*), since a pair of engagement portions is connected to both sides of the projection wall, stability in a holding force is excellent, and since the height is limited to low, a handling is good as well.

(B) The engagement portions include engagement claws provided on faces facing each other and projecting at portions asymmetrical to each other relative to the engaged portion, the engaged portion being configured to be held between the engagement claws. In this configuration, when the engaged portion is elastically engaged, it is easy to forcibly deform through the engagement claws, and in the engagement condition, a retaining force for strong pulling force of the engaged portion can be stably retained.

(C) The engagement portion is swingable relative to a thin portion between the engagement portion and the projection wall as a furculum. The thin portion operates as a hinge of the engagement portion. In this configuration, since the engagement portion can surely deform in the horizontal direction relative to the projection wall with the thin portion as a furculum, the above advantages can be surely obtained, and the engagement operation of the engaged portion can be stably made.

(D) The engagement portion includes an arm portion extending diagonally from a side of the projection wall, and an overhang integrated with a tip of the arm portion and formed with the engagement claw at portions facing to another one. In this configuration, the length is obtained, and a swinging characteristic of the engagement portion is improved.

(E) The projection walls and the engagement portions facing each other keep a predetermined space, respectively, and include inclined faces for guiding, formed to be high outwardly in a direction away from the predetermined space, so that the engaged portion is configured to be inserted and engaged between the engagement portions along the inclined faces. In this configuration, in the operation of sandwiching and engaging the engaged portion between the engagement portions, when the lower enlarged portion (a wire portion) of the engaged portion is pushed and inserted between the engagement portions, it is possible to insert along with the guiding operation of the inclined faces of the respective projection walls and the engagement portions, so that the handling is improved.

(F) The base has a rectangular shape, is formed of a plurality of thick portions and a plurality of thin portions, and is bendable, following deformation of the foam member, through the thin portions or thickness changing portions. In this configuration, when the engaged portion receives a pulling load, the base surely and easily deforms at the thin portions or the thickness changing portions, so that the holding force to the engaged portion can be surely improved.

Advantages of the Invention

In accordance with the present invention, as compared with the structure wherein the engagement portion is engaged with the engaged portion by changing an upper-lower angle relative to the base, as in the engagement portion of the Patent Document 1, the invention provides that the height is limited to low to save a space, and the following advantages.

First, in a using condition where the clip is arranged in the groove portion provided in the foam member, it is possible to respond to a shape where the groove portion is shallow, so that freedom to design relative to the thickness of the foam member or the depth of the groove portion is expanded.

Second, feeling for a product where the foam member is covered by the outer layer is improved. In this respect, for example, assuming that the foam member is a seat cushion forming a seat, since the height of the clip is low relative to the conventional clip, the distance from the outer layer is relatively long, so that when sitting or it is pushed by hands from above, a strange feeling by the clip is hardly felt.

Third, the clip enlarges the freedom to a layout relative to a peripheral product, such as a pull member, as the engaged member, and provides a quality improvement for the applied product.

EMBODIMENTS OF THE INVENTION

Herein below, the best embodiments of the invention are explained with reference to the drawings. In the explanation, the structure of the clip, the using examples thereof and modifications are explained in this order.

Figure 4:
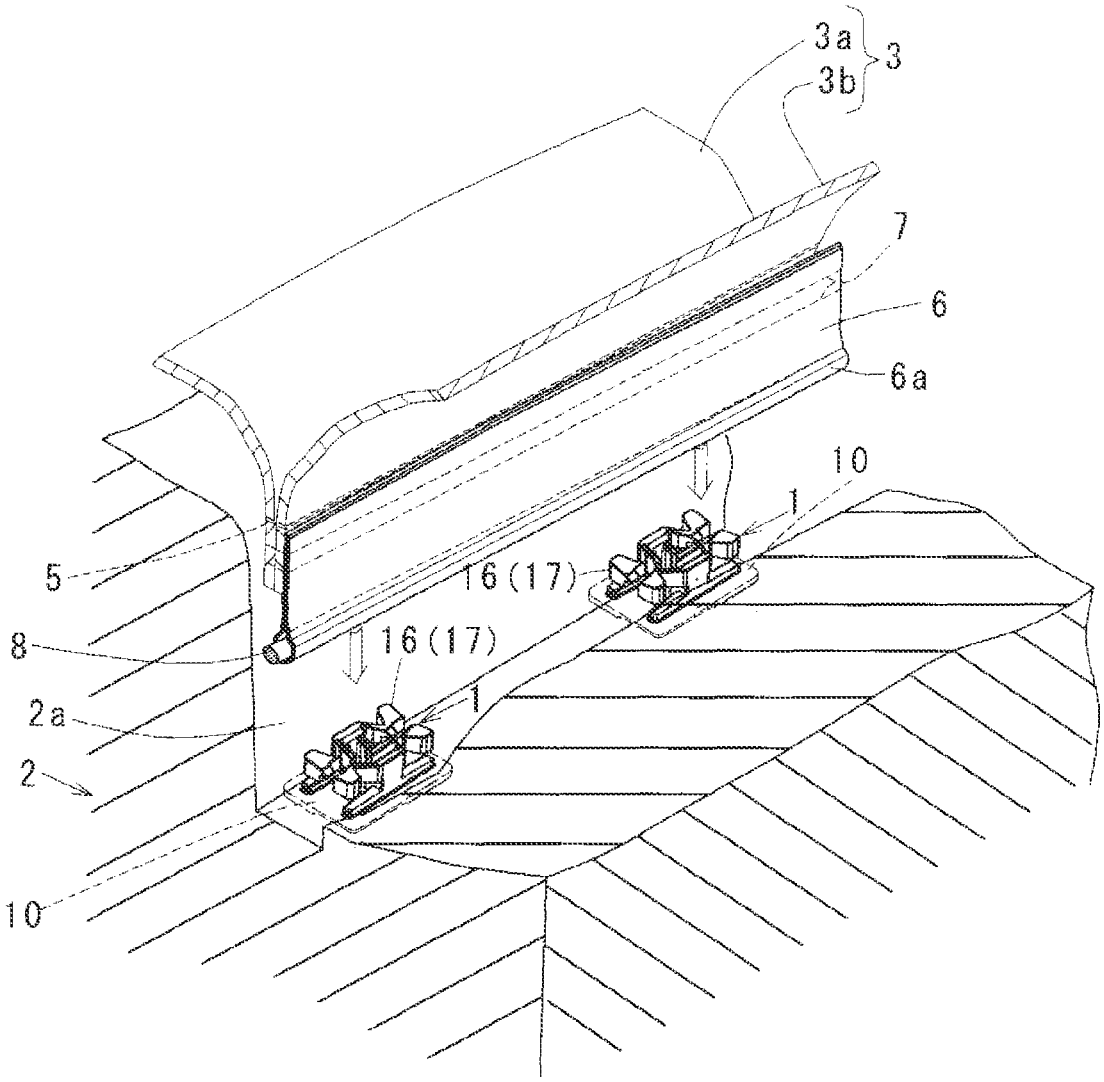
FIG. 4 is a configuration showing a using condition of the outer layer engagement clip.

(Structure) An outer layer engagement clip 1 integrally includes a base 10, a pair of projecting walls 13 erected on the base, and engagement portions 17 extending from side portions of the projecting walls 13. In the clip 1, the base 10 is retained by a foam member 2, as shown in FIG. 4, and a withdrawing member 6 which is an engaged portion provided at a rear side of an outer layer 3 covering the foam member 2 is engaged with an engaging portion 17 by an insertion operation thereinto, i.e. in a condition of preventing withdrawal, the outer layer 3 is held onto a foam member 2 side.

Here, the foam member 2 is a polyurethane foam and so on, and is formed into a various size, thickness and shape, as a seat or seat back supporting a back for cushion and a seat cushion for supporting buttocks. Also, the foam member 2 includes groove portions 2*a* provided between a main portion and two side portions, and the base 10 is buried in a bottom face of the groove portion 2*a*, i.e. the clip 1 is held in the condition of insertion. This structure is the same as that of the Patent Document 1, so if necessary, please refer to the Patent Document.

An outer layer 3 is a member in a shape covering the foam member 2, and is made such that a plurality of outer layer portions 3*a*, 3*b* and so on is sewn according to a shape of the foam member. At that time, in the outer layer portions 3*a*, 3*b*, as shown in FIG. 4, a pull member 6 is attached by, for example, sewing, at a predetermined position of the layer portions. Numerals 5 and 7 are sewing lines. The pull member 6 is, in this example, made by folding a flexible plane material (which is called a mesh suspender), such as similar to cloth, and two edge portions folded back are attached to a cover side by a sewing line 7. In the pull member 6, a stiff wire 8 is held inside a folded back portion, and is arrange along a longitudinal direction. The pull member 6 is inserted and engaged through the wire 8 to an engagement portion 17 of the clip. However, the pull member 6 may be made, other than this example.

Details of the clip are as follows. The clip 1 is a synthetic resin injected material, and comprises a base 10 in a rectangular plate shape, a pair of projection walls 13 erected on a front face of the base 10, and engagement portions 17 arranged to project substantially parallel to the base 10 from two side portions of the projection walls 13.

Figure 5A:
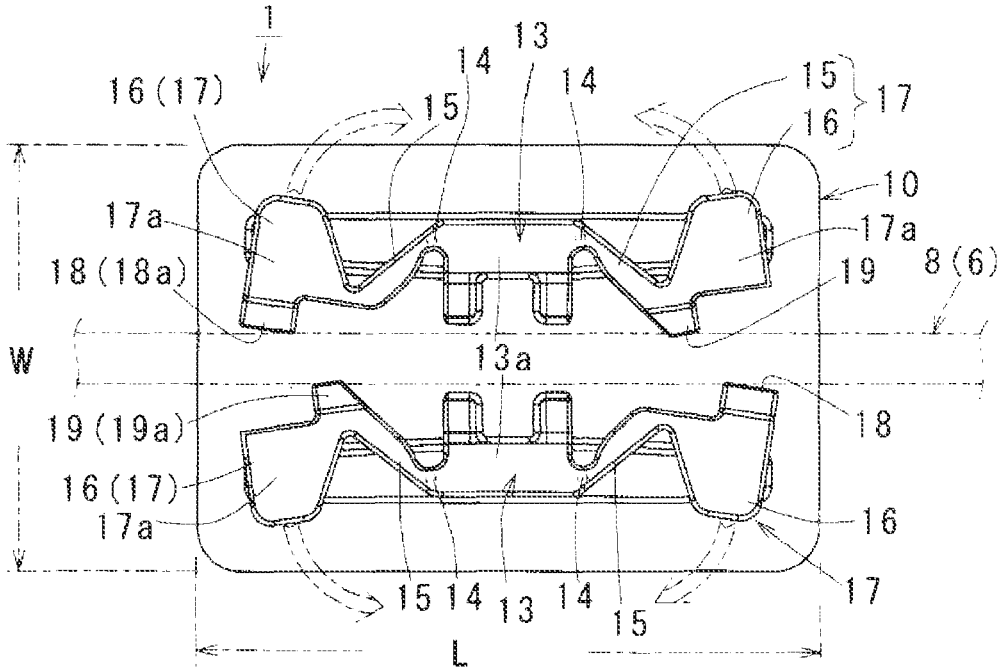
FIGS. 5(*a*) and 5(*b*) show configurations, as an operation 1 of the outer layer engagement clip, wherein FIG. 5(*a*) is a configuration showing a middle of an engagement operation relative to an engagement portion of an engaged portion, and FIG. 5(*b*) is a configuration in a condition where the engaged portion is engaged at the engagement portion, and the outer layer is held to a foam portion side.
Figure 5B:
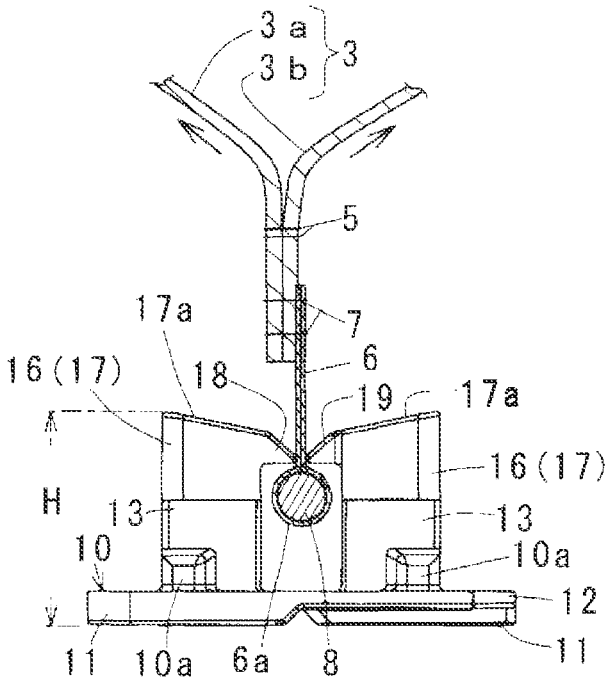

Among these members, the base 10 is made of a plurality of thick portions 11 and a plurality of thin portions 12. Also, in the base 10, in FIG. 5(*a*), a left-right direction corresponds to a longitudinal direction L of a groove 2*a*, an up-down direction corresponds to a width direction W of the groove portion 2*a*, and a front-back direction of a paper corresponds to a depth direction of the groove 2*a* as shown in FIG. 5(*b*). Numeral 10*a* is a strengthening rib projecting from a base upper surface and connected to a corresponding side portion of the projection wall 13. The rib 10*a* is a projection extending in the longitudinal direction of the base 10 and is located at two sides of the projection wall 13 to prevent bending of the engagement portion 17, i.e. breaking down by an outer force applied from an upper side thereof.

Figure 1A:
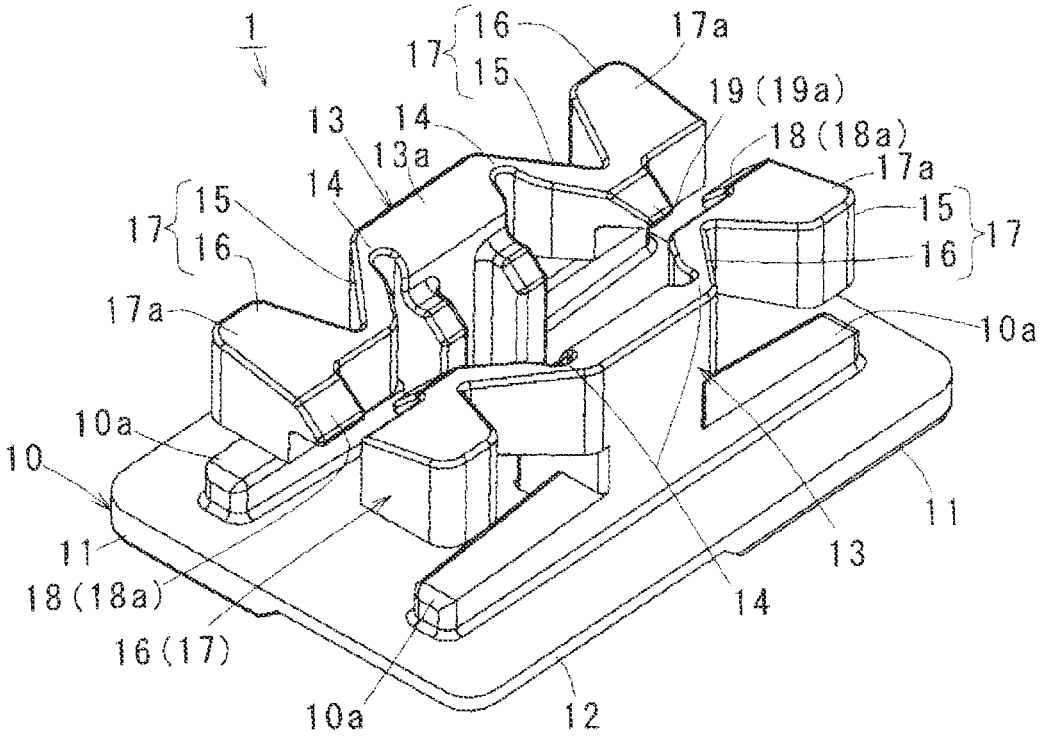
FIGS. 1(*a*) and 1(*b*) are perspective views from an upper side and a lower side showing an outer configuration of an outer layer engagement clip of the invention.
Figure 1B:
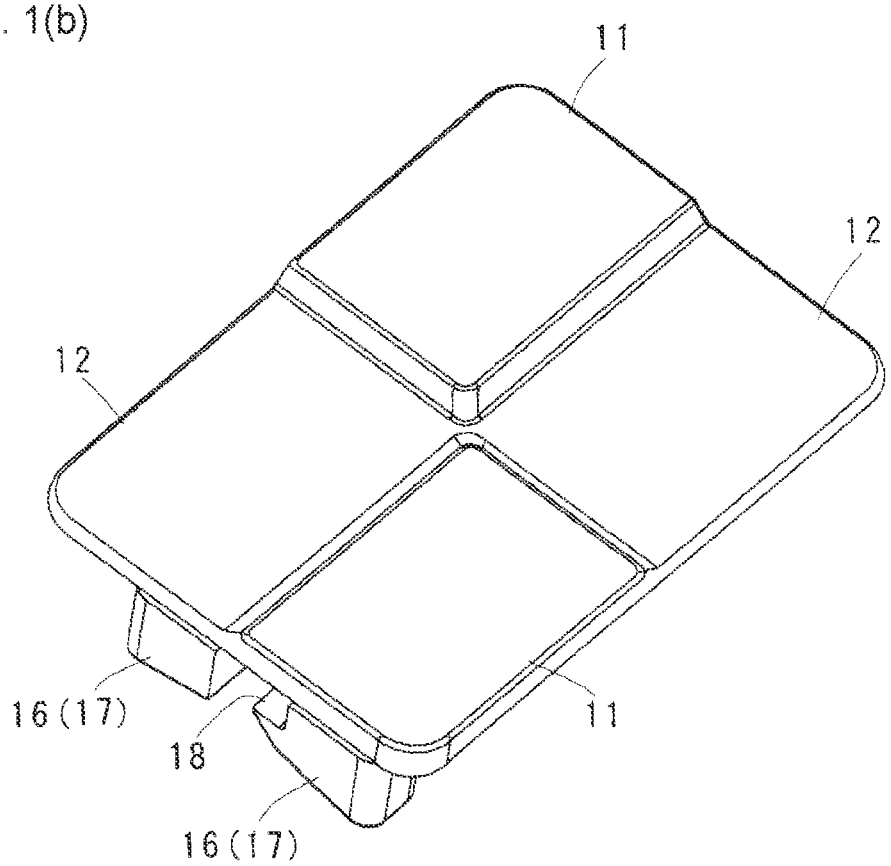
Figure 6A:
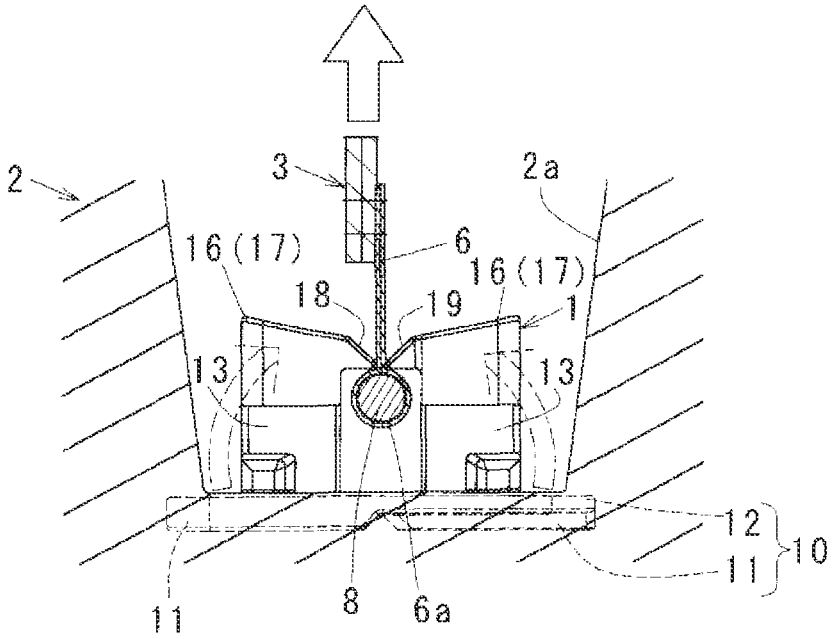
FIGS. 6(*a*) and 6(*b*) show configurations, as an operation 2 of the outer layer engagement clip, wherein the engaged portion is engaged to the engaging portion and the outer layer is held to a foam portion side, showing a change of the base relative to the foam portion when the engaged portion is further pulled in the arrow direction from a condition shown in FIG. 5(*b*).
Figure 6B:
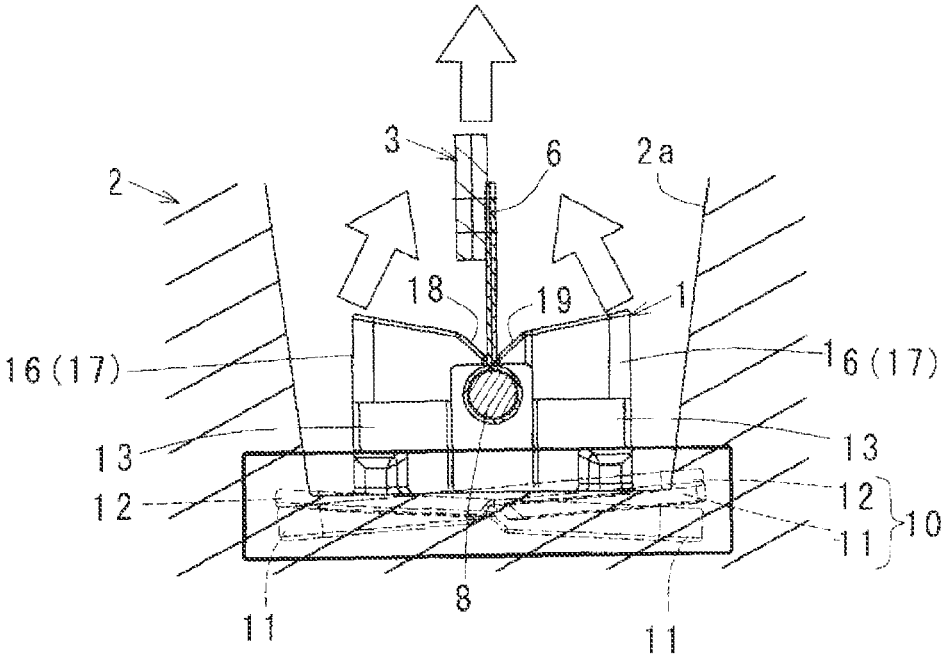

Namely, the base 10 is made flat at the upper surface, and is provided at a lower surface a plurality of thick portions 11, i.e. projected portions, to provide a combination of the thick portions and thin portions. In this example, the lower surface is divided into four by a cross shape, wherein two portions arranged diagonally are formed to have the thick portions, and other two portions are formed to have the thin portions (Refer to FIG. 1(*b*)). In other words, the lower face of the base is divide by four by the cross shape, wherein the shape is set to have different thicknesses diagonally to be different in thickness, to thereby provide different rigidity by the different thicknesses. Accordingly, in the base structure, when an attached member 6 receives a load in a pulling direction, as shown in FIG. 6(*b*), a front side relative to the paper absorbs a load by deformation of the thin portion 12 at a right side, and a rear side relative to the paper absorbs a load by deformation of the thin portion 12 at the left side. Thus, since the load is spread, a possibility of the base 10 from being pulled from an inner bottom of the groove 2*a* of the foam member 2 is eliminated.

Figure 2A:
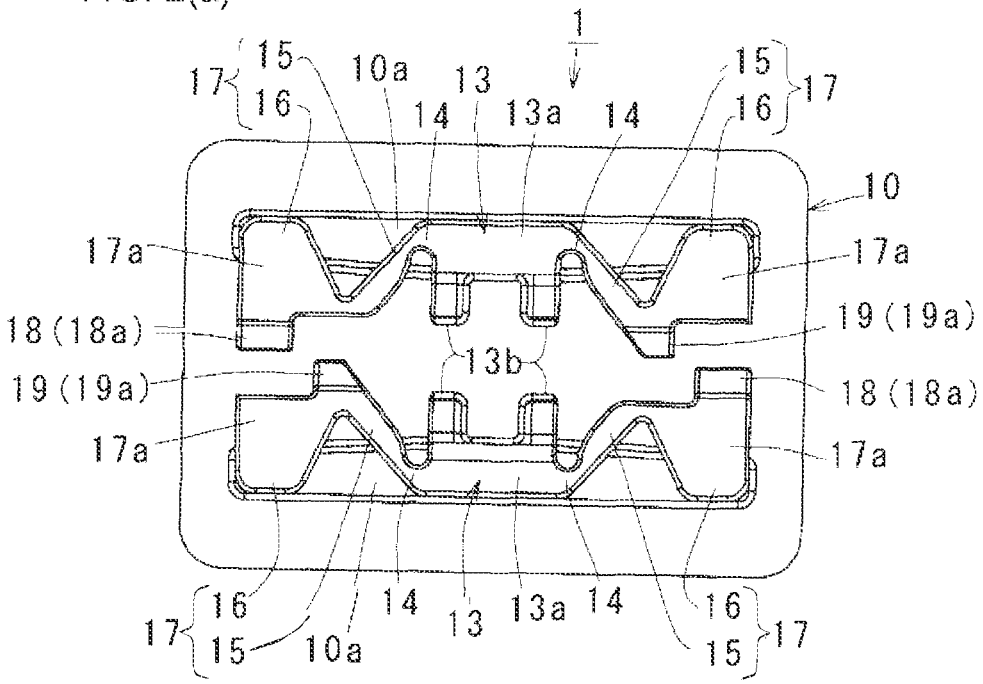
FIGS. 2(*a*)-2(*c*) show details of the outer layer engagement clip, wherein FIG. 2(*a*) is a plan view, FIG. 2(*b*) is a front view, and FIG. 2(*c*) is a bottom view.
Figure 2B:
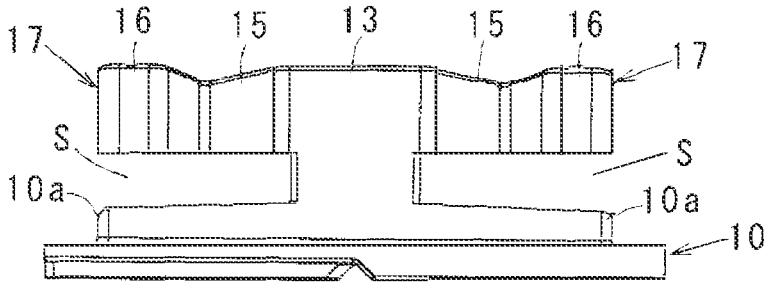
Figure 2C:
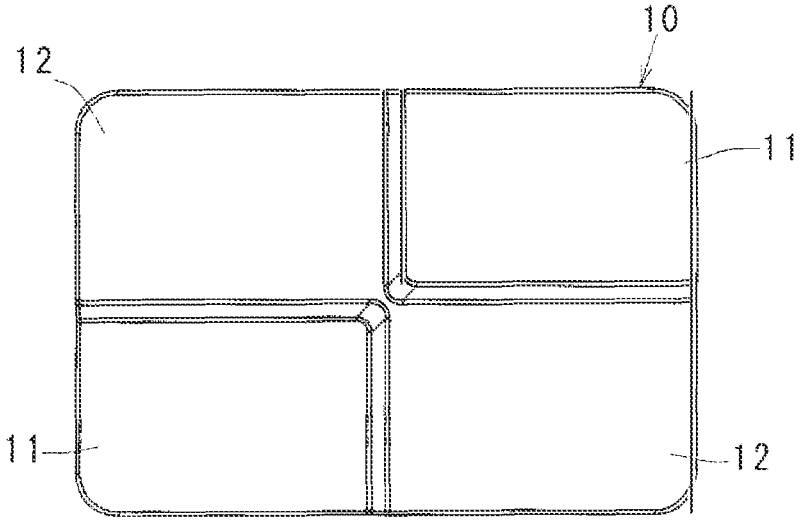
Figure 3A:
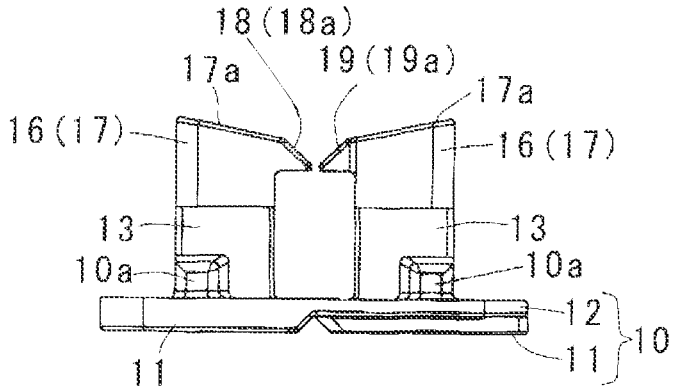
FIG. 3(*a*) is a side view seen from a right direction of FIG. 2(*a*), and FIG. 3(*b*) is a side view seen from a left direction of FIG. 2(*a*).
Figure 3B:
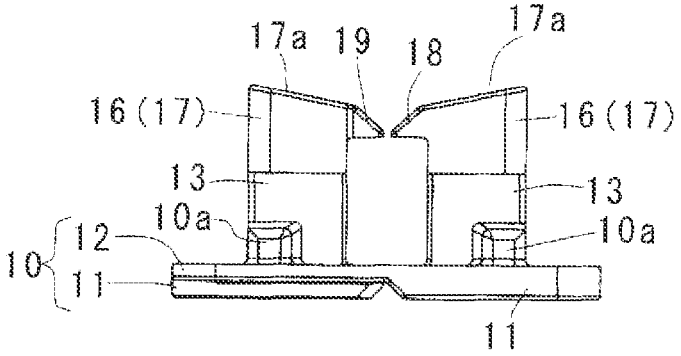

Each projection wall 13 is formed of a rectangular plate shape to face with a predetermined distance to the other, and includes a plurality of strengthening ribs 13*b* provided at a facing face (Refer to FIG. 2(*a*)), and a guiding inclined surface 13*a* provided at an upper face and formed to become high gradually toward an outside departing in a direction away from the other one. The strengthening rib 13*b* is a vertical rib extending in an up-down direction H (Refer to FIG. 5(*b*)) of the projection wall 13, and strengths the projection wall 13 to prevent movement. The guiding inclined surface 13*a* is made to have substantially the same plane to an inclined surface 17*a* of the engagement portion 17 explained later.

In FIGS. 2(*a*) and 2(*b*), each engagement portion 17 is formed on each side of the projection wall 13 (at a side crossing the groove 2*a* in a condition where the clip 1 is arranged along a longitudinal direction of the groove 2*a*), is spaced from the base 10 (strengthening rib 10*a* formed on the front surface of the base 10), and is arranged substantially parallel to the base 10. Also, each engagement portion 17 is formed on the inclined face 17*a* for guiding, where the height of an upper surface of the inclined surface gradually becomes high to an outer side departing from the other engagement portion, and a whole shape is formed of an arm portion 15 and an overhang 16 at a tip side of the arm portion 15.

Each inclined face 17*a* continues to the inclined face 13*a*, and defines a guiding portion in a shape of V together with the inclined face 13*a* facing thereto, and by the guiding portion, the pull member 6 which is an attached portion is easily inserted between the engagement portions.

The arm portions 15 project at two sides of the projection wall 13 through a thin portion 14 as a hinge, and extend in a direction where a distance between the projecting ends of the arms is gradually shortened, namely inwardly inclined. The overhang 16 has a small block shape thinner than the arm portion 15, and an engagement claw 18 or 19 projects at a projecting end. The engagement claws 18, 19 are provided, as shown in FIG. 2(*a*), at facing faces of the engagement portions 17 facing each other, and are arranged at positions projecting asymmetrically relative to the engaged portion (6, 8). Upper surfaces of the engagement claws 18, 19 become inclined faces 18*a*, 19*a* which face down as they go to the tips. The inclined faces 18*a*, 19*a* guide the pull member 6 which is the attached portion, as in the inclined faces 13*a* and the inclined faces 17*a*.

(Using Example) The above clip 1 is used to a seat similar to the Patent Document 1, but it is possible to use the clip in a field of covering a foam member for a cushion by an outer layer. Also, the clip 1 is retained by the foam member as shown in FIGS. 6(*a*) and 6(*b*). In this case, the clip 1, in case of the foam member 2 for a seat, for example, is retained at a bottom side of the groove 2*a* in an indented shape formed between a main portion and a side portion. Generally, in case the foam member 2 is formed by an urethane type foam synthetic resin, the base 10 of the clip is inserted into a corresponding bottom portion of the groove 2*a*. However, the clip 1 may be later attached to the foam member by adhering or welding.

FIG. 4 and FIGS. 6(*a*) and 6(*b*) show an example, wherein the outer layer 3 is inserted at a front enlarged portion (wire portion 8) of the pull member 6 between the engagement portions 17 of the clip 1, and is elastically engaged. In this operation, the pull member 6 is pushed at the portion of the wire 8 into a portion between the engagement portions 17 facing each other, and further into a portion between the engagement claws 18, 19. Then, in this structure, while the portion of the wire 8 is being guided by the inclined faces 13*a*, 13*a* and inclined faces 17*a*, 17*a*, the portion of the wire 8 climbs over a portion between the engagement claws 18, 19, and is inserted and engaged at a portion between the overhangs 16. In the engaged condition, the pull member 6 is prevented from being pulled by, as shown in FIG. 6(*a*), the portion of the wire 8 which abuts against the flat lower surfaces of the engagement claws 18, 19. In this structure, even if the pull member 6 is pulled in the direction of an arrow in FIG. 6(*a*) by the displacement in shape of the outer layer 3 and the famed member 2, the pull member 6 is not accidentally released.

Also, in this structure, if the pull member 6 is further strongly pulled in the upper arrow direction, as shown in FIG. 6(*b*), the pair of engagement portions 17 at both sides of the projection wall 13 receives forces in the upper diagonal directions. In this case, previously, the base buried at a bottom surface side of the groove may sometimes be pulled out from the foam member and disengaged by the forces in the upper diagonal directions. However, in this embodiment, as shown in the broken lines in the drawing, the bae 10 is likely to twist by following the deformation of the foam member 2 through the plurality of thin portions or the thickness change portions, so that the base 10 partly displaces in many directions at the plurality of thin portions or the thickness change portions 11, 12, to thereby surely and easily deform. By the displacement of the base 10 in many directions, the force applied to the base is reduced or released, to be able to prevent the clip from being pulled out of the foam member.

(Other Advantages) First, the clip 1 includes, especially, the engagement portions 17 extending from the side portions of the projection wall 13 in the width direction of the projection wall and capable of moving substantially in parallel to the base 10 or in the horizontal direction, and the pull member 6 is retained between the engagement portions 17 to elastically engage, so that the clip reduces the height as compared with the structure of the Patent Document 1, and is excellent in reducing the space. In particular, (A) as shown in FIG. 4 and FIGS. 6(*a*) and 6(*b*), in the using condition arranged in the groove 2*a* of the foam member 2, it is possible to effectively apply to a case where the thickness of the foam member 2 is relatively thin or the groove 2*a* is shallow. Thus, the design freedom is expanded in the thickness of the foam member 2 and the depth of the groove 2*a*. (B) the clip 1 improves the feeling for a product covering the foam member 2 by the outer layer 3. The reason is that since the height of the clip is relatively low as compared with the conventional clip, the distance from the outer layer 3 is made long as compared with the conventional clip, so that when sitting or pushing by hands from above, a strange feeling derived from the clip 1 is hardly felt. (C) the clip 1 expands freedom to the layout to the peripheral parts, such as the thickness of the foam member 2, the depth of the groove 2*a*, engaged members (6, 8) and so on, expands an application opportunity, and provides quality improvement of the applied product.

Second, since the clip 1 includes the facing engagement portions 17, 17 on both sides of the projection wall 13, an elastic engagement force or holding force relative to the engaged members (6, 8) can be doubled. Also, in this clip 1, since the engagement claws 18, 19 project in the faces of the engagement portions 17 facing each other at positions asymmetrical to each other, as assumed from FIGS. 5(*a*) and 5(*b*), when the engaged members (6, 8) are elastically engaged, the engagement portions 17 are readily deformed forcibly through the engagement claws 18, 19, and in the engaged condition, it is possible to stably retain the holding force relative to the force of the engaged members (6, 8).

Third, since in the clip 1, the respective engagement portions 17 can surely be deformed horizontally relative to the projection wall 13 at the thin portion 14 as a fulcrum, it is possible to perform an engagement operation of the engaged members (6, 8) by one touch, and since the engagement portion 17 includes the arm portion 15 extending diagonally, and an overhang 16 with the engagement claw at the tip of the arm portion 15, it is possible to improve a swing characteristic of the engagement portion 17 while retaining the enough length.

Figure 7A:
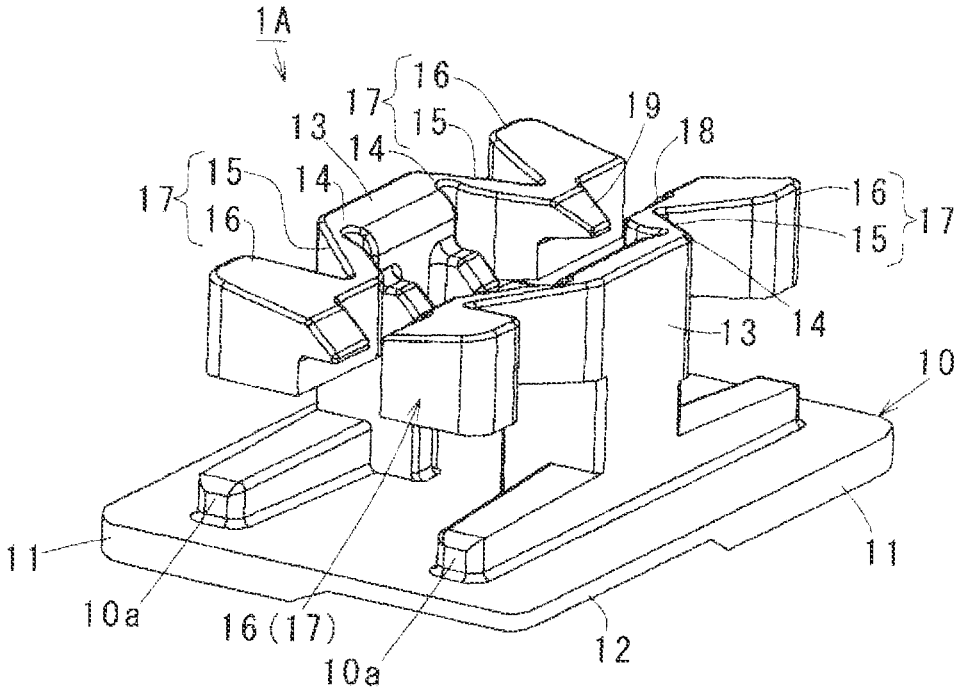
FIGS. 7(*a*) and 7(*b*) show perspective views of modified examples 1 and 2 changing a part of the outer layer engagement clip.
Figure 7B:
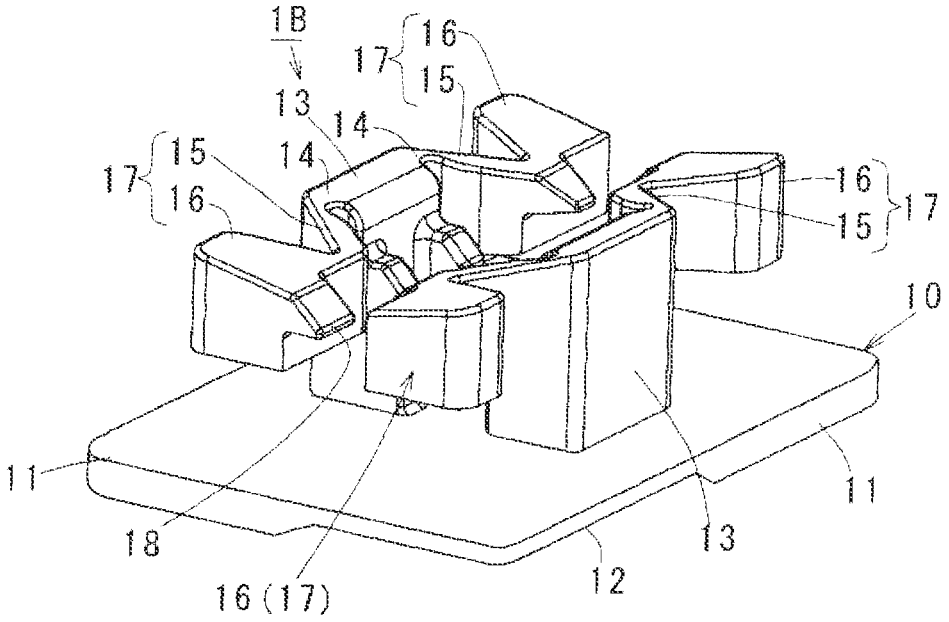
Figure 8A:
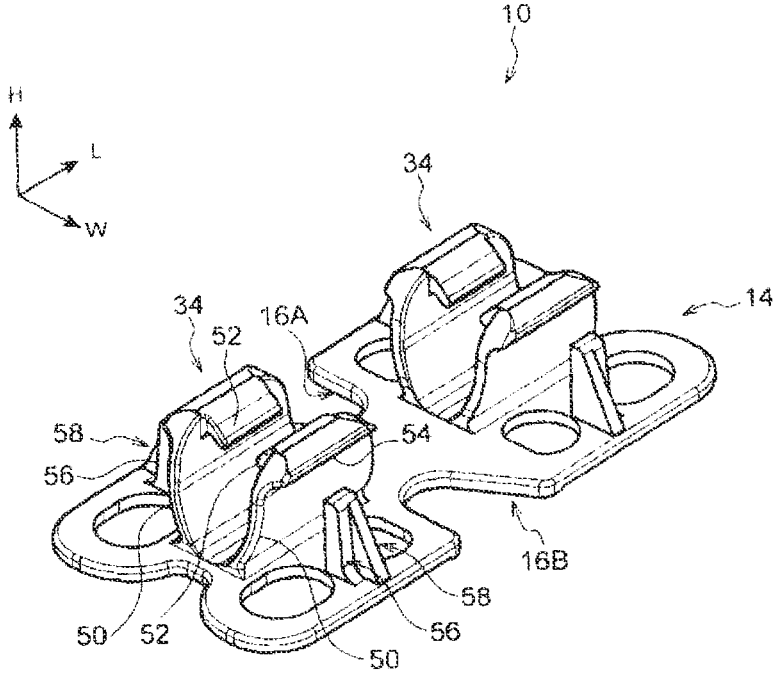
FIG. 8(a) Prior Art
FIGS. 8(*a*) and 8(*b*) are explanation drawings showing FIG. 9 and FIG. 5 of the Patent Document 1.
Figure 8B:
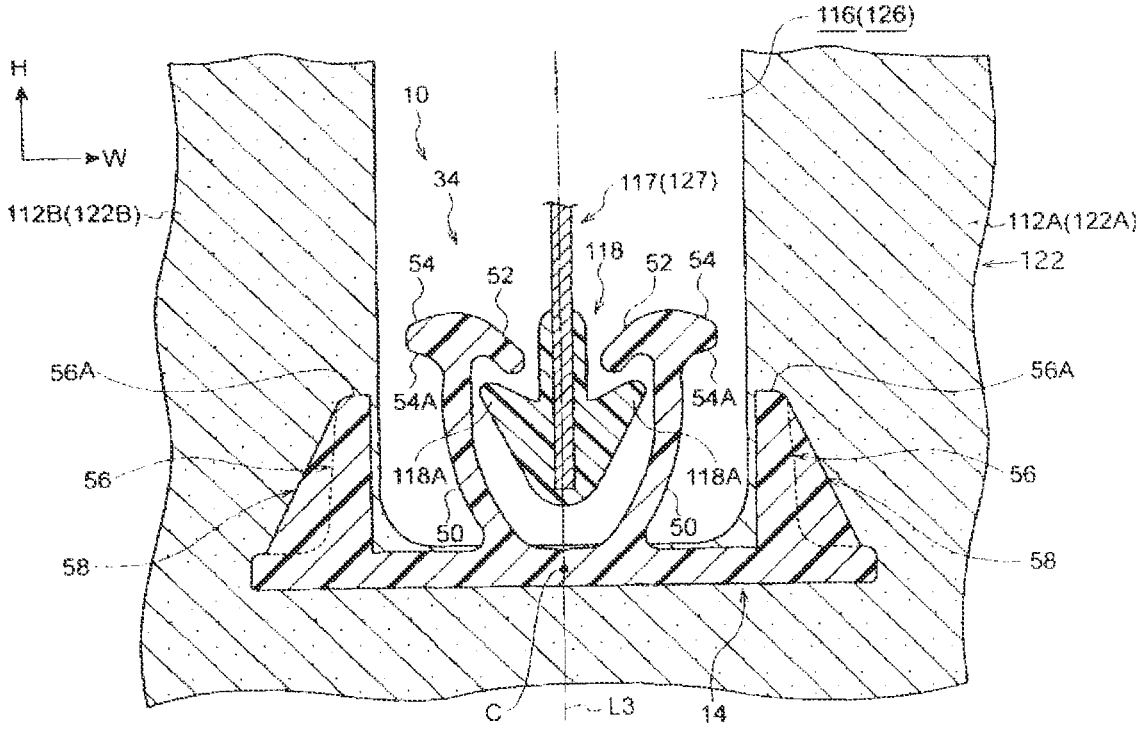
FIG. 8(b) Prior Art

(Modified Examples) A clip 1A of FIG. 7(*a*) shows a modified example 1, wherein a pair of projection walls 13 facing each other is located higher as compared with the clip 1. Namely, the clip 1A is one example where a height is slightly enlarged corresponding to the thickness of the foam member 2 or the depth of the groove 2*a*, and the portions other than those are the same as the above example. Incidentally, the height of the projection wall 13 is set by the shape of the engaged portion, such as the pull member 6. Generally speaking, for example, in case the engaged portion is a wire, the height is low, and in case of a suspender, such as a conventional example, the height is high. A clip 1B of FIG. 7(*b*) is an example simplified by deleting the strengthened rigs 10*a* provided on the base 2, as compared with the clips 7 and 7A, and the portions other than those are the same. As other embodiments, the engagement portions 17 are provided on both sides of the projection wall 13, but the engagement portion 17 may be provided on only one side, and the inclined face 13*a* of the projection wall 13 or inclined face 17*a* of the engagement portion 17 may be omitted so that the upper faces of the projection wall 13 and the engagement portion 17 are made flat.

As explained above, the present invention may be provided with the structure as defined in the claims, and it is possible to change the details as required, as shown in the modified examples 1 and 2. Also, the clip is not limited to the seat, and may be used for a product covering a foam member for cushion with an outer layer, such as a sofa, and so on.

EXPLANATION OF NUMERALS

1 Clip
2 Foam member
3 Outer layer
6 Pull member (Engaged member)
8 Wire (Engaged member)
10 Base (11: Thick portion, 12: Thin portion)
13 Projection wall (13*a*: Inclined face)
14 Thin portion
15 Arm portion
16 Overhang
17 Engagement portion (17*a*: Inclined face)
18 Engagement claw
19 Engagement claw
1A Clip
1B Clip Incidentally, the present invention cites all contents of a specification, claims, drawings and abstract of Japanese Patent Application No. 2019-57523 filed on Mar. 26, 2019, and the contents are incorporated herein as a disclosure of the specification of the invention.

What is claimed is:

1. A clip for engagement of an outer layer, the outer layer covering a foam member in a state held by the foam member being caught to a foam member side by engagement of an engaged portion provided at a rear side of the outer layer, the clip comprising:

a base configured to be held by the foam member, a pair of projection walls erected on the base and facing each other, and engagement portions extending from side portions in a width direction of the projection walls, and arranged to be swingable with respect to the projection walls, substantially parallel to the base or horizontally, wherein the engaged portion is configured to be sandwiched between the engagement portions to elastically engage, and the base has a rectangular shape, is formed of a plurality of thick portions and a plurality of thin portions, and is bendable through thickness changing portions or the thin portions following deformation of the foam member.

2. A clip for engagement of an outer layer, the outer layer covering a foam member in a state held by the foam member being caught to a foam member side by engagement of an engaged portion provided at a rear side of the outer layer, the clip comprising:

a base configured to be held by the foam member, a pair of projection walls erected on the base and facing each other, and engagement portions extending from side portions in a width direction of the projection walls, and arranged to be swingable substantially parallel to the base or horizontally, wherein the engaged portion is configured to be sandwiched between the engagement portions to elastically engage, and the engagement portions are provided on two sides of each projection wall.

3. A clip for engagement of an outer layer, the outer layer covering a foam member in a state held by the foam member being caught to a foam member side by engagement of an engaged portion provided at a rear side of the outer layer, the clip comprising:

a base configured to be held by the foam member, a pair of projection walls erected on the base and facing each other, and engagement portions extending from side portions in a width direction of the projection walls, and arranged to be swingable substantially parallel to the base or horizontally, wherein the engaged portion is configured to be sandwiched between the engagement portions to elastically engage, and the engagement portions include engagement claws provided on faces facing each other and projecting at portions offset from one another relative to the engaged portion, the engaged portion being configured to be held between the engagement claws.

4. A clip for engagement of an outer layer according to claim 3, wherein each engagement portion includes an arm portion extending diagonally from a side of each projection wall, and an overhang integrated with a tip of the arm portion and formed with each engagement claw.

5. A clip for engagement of an outer layer according to claim 2, wherein each engagement portion is swingable relative to a thin portion between the engagement portions and the projection walls.

6. A clip for engagement of an outer layer according to claim 2, wherein the projection walls and the engagement portions facing each other keep a predetermined space, respectively, and include inclined faces for guiding formed higher in a direction away from the predetermined space, so that the engaged portion is configured to be inserted and engaged between the engagement portions along the inclined faces.

* * * * *